US009994350B2

(12) United States Patent
Labadie et al.

(10) Patent No.: US 9,994,350 B2
(45) Date of Patent: Jun. 12, 2018

(54) THREADED FINISH FOR NONREMOVABLE CLOSURES

(75) Inventors: Joseph P. Labadie, Perrysburg, OH (US); Lance J. Novotny, Gibsonburg, OH (US); Richard R. Johnston, Toledo, OH (US)

(73) Assignee: GRAHAM PACKAGING COMPANY, L.P., Lancaster, PA (US)

( * ) Notice: Subject to any disclaimer, the term of this patent is extended or adjusted under 35 U.S.C. 154(b) by 1228 days.

(21) Appl. No.: 12/777,743

(22) Filed: May 11, 2010

(65) Prior Publication Data

US 2011/0278313 A1 Nov. 17, 2011

(51) Int. Cl.
*B65B 7/28* (2006.01)
*B65D 1/02* (2006.01)

(52) U.S. Cl.
CPC ..... *B65D 1/0246* (2013.01)

(58) Field of Classification Search
CPC ..... B65D 39/08; B65D 41/0471; B65D 41/0478; B65D 41/04; B65D 2501/0081; B29C 49/06
USPC ..... 215/330, 331, 44, 329; 220/289
See application file for complete search history.

(56) References Cited

U.S. PATENT DOCUMENTS

| | | | | |
|---|---|---|---|---|
| 4,460,100 | A | 7/1984 | Libit | |
| 4,780,257 | A * | 10/1988 | Beck | 264/40.1 |
| 4,907,709 | A * | 3/1990 | Abe et al. | 215/252 |
| 5,360,127 | A | 11/1994 | Barriac et al. | |
| 5,494,174 | A | 2/1996 | Rohr et al. | |
| 5,735,417 | A * | 4/1998 | Darr et al. | 215/216 |
| 6,913,157 | B2 | 7/2005 | Oh | |
| 2004/0140284 | A1* | 7/2004 | Taylor et al. | 215/42 |
| 2010/0314348 | A1* | 12/2010 | Zoppas et al. | 215/44 |

FOREIGN PATENT DOCUMENTS

WO WO/2009/053921 * 4/2009 ..... B65D 1/02

* cited by examiner

*Primary Examiner* — Andrew T Kirsch
*Assistant Examiner* — Kevin Castillo
(74) *Attorney, Agent, or Firm* — Baker Botts L.L.P.

(57) ABSTRACT

A finish portion for a plastic container includes a threaded portion having at least one helical thread and a substantially flat thread positioned beneath the helical thread. The helical thread is merged into the flat thread. A transfer bead is positioned beneath the threaded portion and a gripping indentation is defined between the threaded portion and the transfer bead for facilitating automated conveyance. The gripping indentation may be shaped so that no separate ledge is defined between the threaded portion and the transfer bead. The gripping indentation may have a height that is at least about 0.085 inch. The finish portion has a maximum thread diameter and a maximum height, and a ratio of the maximum thread diameter to the maximum height may be at least about 2.3.

20 Claims, 2 Drawing Sheets

THREADED FINISH FOR NONREMOVABLE CLOSURES

BACKGROUND OF THE INVENTION

1. Field of the Invention

This invention relates generally to the field of plastic containers and closures therefor, and more specifically to a threaded finish for a nonremovable closure that is more material efficient than the predecessor technology.

2. Description of the Related Technology

Plastic containers that are manufactured from a material such as polyethylene terephthalate (PET) using the well-known reheat stretch blow molding process typically include a threaded finish portion that has at least one helical thread for receiving a closure, such as a closure cap or a dispensing closure.

One type of a conventional finish portion 10 for a plastic container that is specifically designed to resist removal of a closure from the container by a consumer is shown in FIG. 1. Finish portion 10 includes a threaded portion 12 that has a helical thread 14 and a flat or horizontal thread 16 positioned beneath the helical thread 14. The helical thread 14 and the horizontal thread 16 are configured so that the helical thread 14 merges into the horizontal thread 16. As a result, the threads of a closure that is twisted on to the finish portion 10 will first be guided by the helical thread 14 and then snapped downward over the flat or horizontal thread 16 into a position where it will be difficult for a consumer to remove the closure from the container. Such a closure configuration is commonly referred to as a nonremovable closure.

The finish portion 10 of the container that is shown in FIG. 1 further includes a transfer bead 18 and a shape to define a gripping indentation 20 between the transfer bead 18 and the threaded portion 12. The purpose of the transfer bead 18 and the gripping indentation 20 is to facilitate automated robotic handling of the container during the container manufacturing process and the filling process.

The gripping indentation 20 of the conventional container that is shown in FIG. 1 has a shape that is substantially square when viewed in longitudinal cross-section because of the presence of a prominent ledge 22 having an outer substantially vertical sidewall 24 between the gripping indentation 20 and the transfer bead 18. While such containers have been used effectively for their intended purposes the present inventors have determined that the inclusion of the prominent ledge 22 is not necessary in order to facilitate handling of the container. The inclusion of the prominent ledge 22 accordingly requires unnecessary additional plastic material that makes the conventional design suboptimal in terms of its material efficiency and environmental suitability. A need exists for an improved finish configuration for a nonremovable closure that is more material efficient and environmentally sound than that of the predecessor technology.

SUMMARY OF THE INVENTION

Accordingly, it is an object of the invention to provide an improved finish configuration for a nonremovable closure that is more material efficient and environmentally sound than the predecessor technology.

In order to achieve the above and other objects of the invention, a finish portion for a plastic container according to a first aspect of the invention includes a threaded portion having at least one helical thread and a substantially flat thread positioned beneath the helical thread. The helical thread is merged into the flat thread. A transfer bead is positioned beneath the threaded portion. A gripping indentation is defined between the threaded portion and the transfer bead, and the gripping indentation is shaped so that no separate ledge is defined between the threaded portion and the transfer bead.

A finish portion for a plastic container according to a second aspect of the invention includes a threaded portion having at least one helical thread and a substantially flat thread positioned beneath the helical thread. The helical thread is merged into the flat thread. A transfer bead is positioned beneath the threaded portion. The finish portion has a maximum thread diameter and a maximum height, and a ratio of the maximum thread diameter to the maximum height is at least about 2.3.

A finish portion for a plastic container according to a third aspect of the invention includes a threaded portion having at least one helical thread and a substantially flat thread positioned beneath the helical thread. The helical thread is merged into the flat thread. A transfer bead is positioned beneath the threaded portion. A gripping indentation is defined between the threaded portion and the transfer bead, and the gripping indentation has a height that is at least about 0.085 inch.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 2:
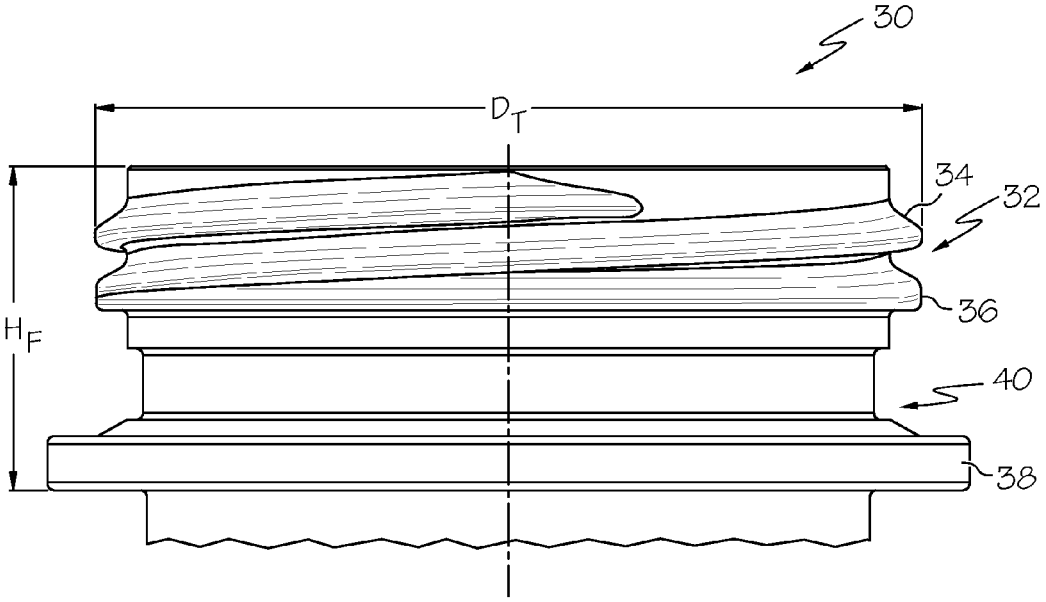
FIG. 2 is a side elevational view of a finish portion for a nonremovable closure according to a preferred embodiment of the invention.

Referring now to the drawings, wherein like reference numerals designate corresponding structure throughout the views, and referring in particular to FIG. 2, a finish portion 30 for a plastic container that is constructed according to a preferred embodiment of the invention is preferably fabricated from the material such as polyethylene terephthalate, which is commonly known by the acronym PET.

Finish portion 30 includes a threaded portion 32 that includes a helical thread 34 and a substantially flat or horizontal thread 36 that is positioned beneath the helical thread 34. The helical thread 34 and the flat or horizontal thread 36 are constructed and arranged to receive at least one internal thread of a closure, such as a closure cap or a dispensing closure. The internal thread of the closure will be guided by the helical thread 34 when the closure is screwed onto the finish portion 30 so that the internal thread will snap downwardly and become engaged against a lower surface of the flat or horizontal thread 36, making it difficult for a consumer to remove the closure from the container that includes the finish portion 30. Accordingly, the finish portion 30 is part of a nonremovable closure configuration.

Referring again to FIG. 2, it will be seen that a transfer bead 38 extends radially outwardly from a lower end of the finish portion 30 beneath the threaded portion 32. In addition, a gripping indentation 40 is defined between the threaded portion 32 and the transfer bead 38. The purpose of the transfer bead 38 and the gripping indentation 40 is to facilitate automated handling and conveyance of the container bearing the finish portion 30 during the container manufacturing and filling processes.

Figure 1:
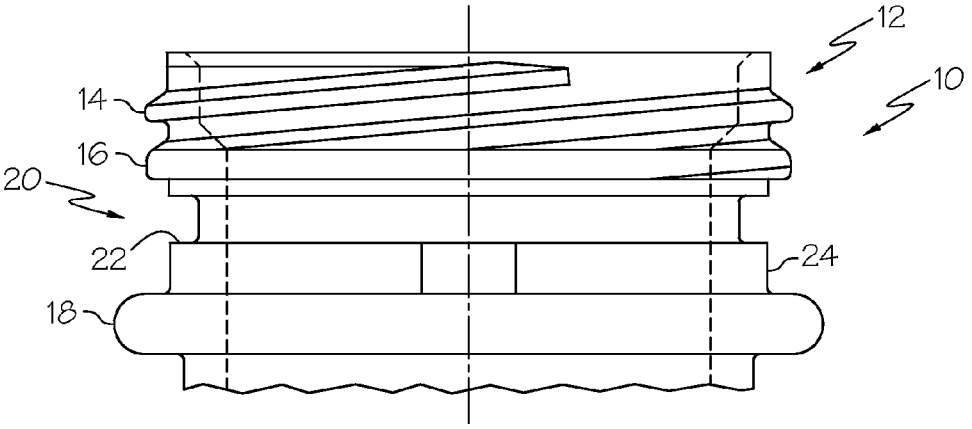
FIG. 1 (PRIOR ART)
FIG. 1 is a diagrammatical side elevational view of a conventional finish portion for a nonremovable closure configuration.
Figure 3:
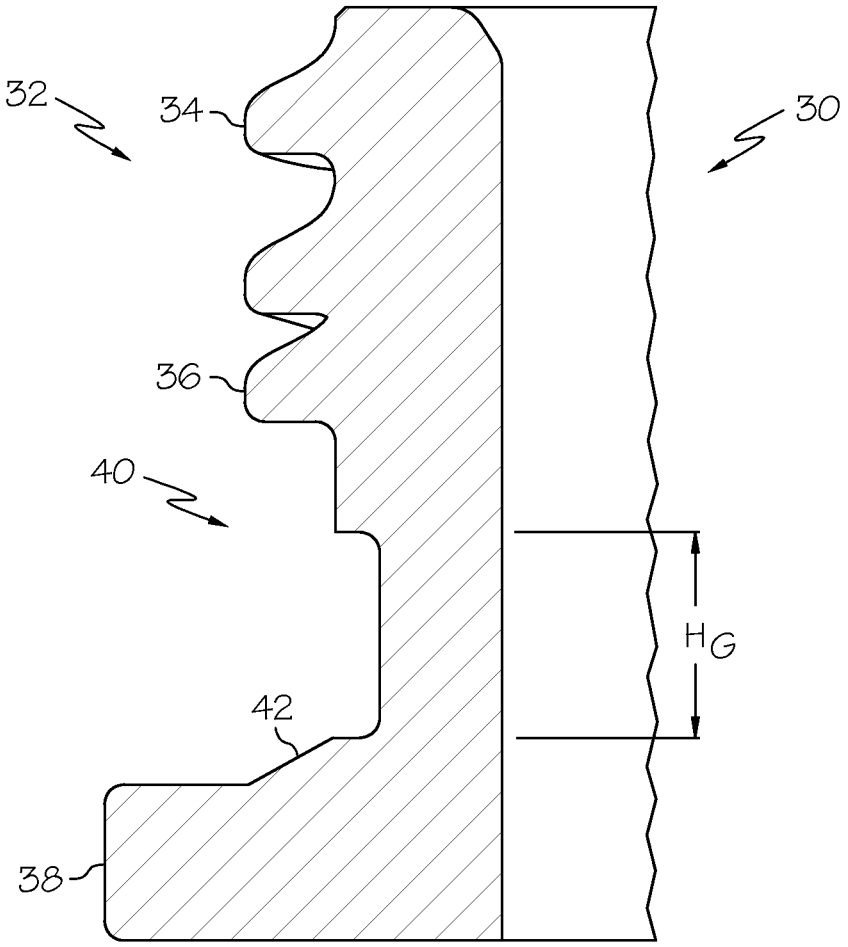
FIG. 3 is a longitudinal cross-sectional view of the finish portion that is shown in FIG. 2.

As FIG. 3 shows, the transfer bead 38 may have a tapered upper surface 42. However, no separate ledge having a substantially vertical outer surface is defined between the threaded portion 32 and the transfer bead 38. Accordingly, the finish portion 30 achieves substantial lightweighting advantages with respect to the predecessor technology described above with reference FIG. 1.

As FIG. 2 shows, the finish portion 30 has a maximum thread diameter $D_T$ and a maximum height $H_F$. Preferably, a ratio of the maximum thread diameter $D_T$ to the maximum height $H_F$ is at least about 2.3. More preferably, a ratio of the maximum thread diameter $D_T$ to the maximum height $H_F$ is at least about 2.5. Most preferably, a ratio of the maximum thread diameter $D_T$ to the maximum height $H_F$ is at least about 3.0. The ratio of the maximum thread diameter to the maximum height is greater than that of the predecessor technology because of the elimination of the separate ledge having the substantially vertical outer surface.

Referring again to FIG. 3, the gripping indentation 40 preferably has a height $H_G$ that is at least about 0.085 inch, and that is more preferably at least about 0.095 inch. The height $H_G$ is greater than that of the predecessor technology that is described in FIG. 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A finish portion for a plastic container, the finish portion defining a vertical axis and comprising:

a threaded portion having at least one helical thread and a flat thread positioned beneath the helical thread, the helical thread being merged into the flat thread, wherein the threaded portion includes a maximum thread diameter;

a transfer bead extending radially outwardly from a lower end of the finish portion, the transfer bead positioned beneath the threaded portion and the transfer bead extending entirely about the finish portion; and a gripping indentation defined between the threaded portion and the transfer bead, wherein the transfer bead comprises a vertical outer cylindrical surface and an upper surface disposed between the vertical outer cylindrical surface and the gripping indentation to define a uniform cross-sectional profile of the transfer bead about an entire circumference of the finish portion, with no separate ledge having a vertical outer surface defined between the gripping indentation and the transfer bead.

2. A finish portion for a plastic container according to claim 1, wherein the gripping indentation has a height that is at least 0.085 inch.

3. A finish portion for a plastic container according to claim 2, wherein the gripping indentation has a height that is at least 0.095 inch.

4. A finish portion for a plastic container according to claim 1, wherein the finish portion has a maximum thread diameter and a maximum height, and wherein a ratio of the maximum thread diameter to the maximum height is at least 2.3.

5. A finish portion for a plastic container according to claim 4, wherein the ratio of the maximum thread diameter to the maximum height is at least 2.5.

6. A finish portion for a plastic container according to claim 5, wherein the ratio of the maximum thread diameter to the maximum height is at least 3.0.

7. A finish portion for a plastic container according to claim 1, wherein the finish portion is fabricated from a material comprising polyethylene terephthalate.

8. The finish portion for a plastic container according to claim 1, wherein an end of the finish portion above the threaded portion has a first diameter and the gripping indentation has a second diameter less than the first diameter.

9. The finish portion for a plastic container according to claim 1, wherein the upper surface of the transfer bead comprises a tapered upper portion of increasing height.

10. A finish portion for a plastic container, the finish portion defining a vertical axis and comprising:

a threaded portion having at least one helical thread and a flat thread positioned beneath the helical thread, the helical thread being merged into the flat thread, wherein the threaded portion includes a maximum thread diameter;

a transfer bead extending radially outwardly from a lower end of the finish portion, the transfer bead being positioned beneath the threaded portion and the transfer bead extending entirely about the finish portion;

a gripping indentation defined between the threaded portion and the transfer bead, wherein the transfer bead comprises a vertical outer cylindrical surface and a horizontal upper surface disposed between the vertical outer cylindrical surface and the gripping indentation to define a uniform cross-sectional profile of the transfer bead about an entire circumference of the finish portion, with no separate ledge having a vertical outer surface defined between the gripping indentation and the transfer bead.

11. A finish portion for a plastic container according to claim 10, wherein the ratio of the maximum thread diameter to the maximum height is at least 2.3.

12. A finish portion for a plastic container according to claim 11, wherein the ratio of the maximum thread diameter to the maximum height is at least 3.0.

13. A finish portion for a plastic container according to claim 10, wherein the gripping indentation has a height that is at least 0.085 inch.

14. A finish portion for a plastic container according to claim 13, wherein the gripping indentation has a height that is at least 0.095 inch.

15. The finish portion for a plastic container according to claim 10, wherein the upper surface of the transfer bead comprises a tapered upper portion of increasing height.

16. A finish portion for a plastic container, the finish portion defining a vertical axis and comprising:

a threaded portion having at least one helical thread and a flat thread positioned beneath the helical thread, the helical thread being merged into the flat thread, wherein the threaded portion includes a maximum thread diameter;

a transfer bead extending radially outwardly from a lower end of the finish portion, the transfer bead being positioned beneath the threaded portion and the transfer bead extending entirely about the finish portion; and a gripping indentation defined between the threaded portion and the transfer bead, wherein the transfer bead comprises a vertical outer cylindrical surface and an upper surface disposed between the vertical outer circumferential surface and the gripping indentation to define a uniform cross-sectional profile of the transfer bead about an entire circumference of the finish portion, with no separate ledge having a vertical outer surface defined between the gripping indentation and the transfer bead, the upper surface including a planar horizontal portion and a tapered portion of increasing height.

17. A finish portion for a plastic container according to claim 16, wherein the gripping indentation has a height that is at least 0.085 inch.

18. A finish portion for a plastic container according to claim 16, wherein the finish portion has a maximum thread diameter and a maximum height, and wherein a ratio of the maximum thread diameter to the maximum height is at least 2.3.

19. A finish portion for a plastic container according to claim 18, wherein the ratio of the maximum thread diameter to the maximum height is at least 2.5.

20. A finish portion for a plastic container according to claim 19, wherein the ratio of the maximum thread diameter to the maximum height is at least 3.0.

* * * * *